US006969295B1

(12) United States Patent
Sidwell

(10) Patent No.: US 6,969,295 B1
(45) Date of Patent: Nov. 29, 2005

(54) BALLOON PEDESTAL

(76) Inventor: Paul E. Sidwell, 1986 Larchmont Dr., Deland, FL (US) 32724

( * ) Notice: Subject to any disclaimer, the term of this patent is extended or adjusted under 35 U.S.C. 154(b) by 0 days.

(21) Appl. No.: 10/838,257

(22) Filed: May 5, 2004

(51) Int. Cl.[7] ..... A63H 3/06
(52) U.S. Cl. ..... 446/220
(58) Field of Search ..... 446/220–224; 403/349

(56) References Cited

U.S. PATENT DOCUMENTS

| | | | | | |
|---|---|---|---|---|---|
| 2,601,088 | A | * | 6/1952 | Burgess | 248/539 |
| 2,664,667 | A | * | 1/1954 | Burroughs | 446/222 |
| 2,840,948 | A | * | 7/1958 | Stickley | 446/223 |
| 3,267,604 | A | * | 8/1966 | Goldsmith | 446/222 |
| 4,365,581 | A | * | 12/1982 | Margiloff | 116/52 |
| 4,589,854 | A | | 5/1986 | Smith | |
| 4,650,147 | A | * | 3/1987 | Griffin | 248/539 |
| 4,661,081 | A | * | 4/1987 | Basseches | 446/220 |
| 4,836,706 | A | * | 6/1989 | Mitchell | 403/24 |
| 4,879,823 | A | * | 11/1989 | Collins | 40/124.01 |
| 4,895,545 | A | | 1/1990 | Nelson | |
| D313,214 | S | | 12/1990 | Phillips et al. | |
| 5,021,022 | A | * | 6/1991 | Ganz | 446/220 |
| 5,042,168 | A | * | 8/1991 | Kyle | 33/809 |
| D322,413 | S | | 12/1991 | Castillo | |
| 5,295,891 | A | * | 3/1994 | Schalk | 446/222 |
| D360,844 | S | | 8/1995 | Miller et al. | |
| 5,463,974 | A | * | 11/1995 | Seeder | 116/173 |
| 5,513,622 | A | * | 5/1996 | Musacchia, Sr. | 124/89 |
| 5,524,857 | A | * | 6/1996 | Eisenberg et al. | 248/535 |
| 5,588,897 | A | * | 12/1996 | Valentino | 446/217 |
| 5,738,560 | A | * | 4/1998 | Bears | 446/220 |
| 5,944,576 | A | * | 8/1999 | Nelson et al. | 446/220 |
| 6,010,107 | A | * | 1/2000 | Goldfarb | 248/512 |
| 6,129,035 | A | * | 10/2000 | Schweinberger | 116/28 R |
| 6,375,534 | B1 | * | 4/2002 | Burns | 446/220 |
| 6,579,030 | B2 | * | 6/2003 | Uhler et al. | 403/348 |

FOREIGN PATENT DOCUMENTS

| | | |
|---|---|---|
| GB | 2272170 | 5/1994 |

* cited by examiner

*Primary Examiner*—Derris H. Banks
*Assistant Examiner*—Faye Francis
(74) *Attorney, Agent, or Firm*—Stephen R. Greiner

(57) ABSTRACT

A balloon pedestal including a mounting bracket for attachment to a land vehicle. The mounting bracket has a hook portion for grasping the top of a window of a land vehicle and a base portion secured to the hook portion. The base portion is provided with a keyhole. A balloon support is releasably joined to the mounting bracket. The balloon support has a mount with a key for selective insertion into, and rotation within, the keyhole and a handle for manipulating the key. Rotation of the key within the keyhole selectively locks the balloon support to the mounting bracket. A rod extends upwardly from the handle. A cup is positioned atop the rod for carrying a balloon.

9 Claims, 1 Drawing Sheet

BALLOON PEDESTAL

FIELD OF THE INVENTION

The present invention relates generally to amusement devices and, more particularly, to inflatable toys.

BACKGROUND OF THE INVENTION

Automobile dealers frequently tie helium-filled balloons to cars that they are offering for sale to attract the interest of passersby and to generate a festive atmosphere for conducting business. Unfortunately, helium-filled balloons leak over time and sag to the ground, producing a less than cheerful impression in potential car buyers. Automobile dealers, therefore, must frequently replace balloons-a costly undertaking since both manpower and helium are costly.

SUMMARY OF THE INVENTION

In light of the problems associated with the constant replacement of balloons by automobile dealers seeking to attract buyers onto their lots, it is a principal object of the invention to provide a balloon pedestal that supports an inexpensive, air-filled balloon above an automobile in a manner that closely simulates the look of a helium-filled balloon on a string. While the air-filled balloon may deflate as rapidly as a helium-filled one, the balloon pedestal, being relatively rigid, will not prevent it from gravitating downward as buoyancy is lost. Thus, the balloon pedestal greatly reduces the frequency that an automobile dealer need replace balloons about his property.

It is a further object of the present invention to provide a balloon pedestal of the type described that permits a balloon to be quickly released from an automobile without tinkering with the automobile. Thus, in the event of an impending storm of a severe nature, or on evenings when an automobile dealership is closed, balloons can be gathered up to prevent their potential loss and stored in a secure place for subsequent reuse.

It is another object of the invention to provide a balloon pedestal of the type described that can be set up with minimal instruction and without resort to any tools. The balloon pedestal is believed to be particularly intuitive to use.

It is an object of the invention to provide improved elements and arrangements thereof in a balloon pedestal for the purposes described which is lightweight in construction, inexpensive to manufacture, and fully dependable in use.

Briefly, the balloon pedestal in accordance with this invention achieves the intended objects by featuring a mounting bracket having a hook portion for grasping the top of a window of a land vehicle and a base portion secured to the hook portion. The base portion is provided with a keyhole. A balloon support is releasably joined to the mounting bracket. The balloon support has a mount with a key for selective insertion into, and rotation within, the keyhole and also has a handle for manipulating the key. A rod extends upwardly from the handle. Positioned atop the rod is a cup for carrying a balloon.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figures 1, 2, 3, 4:
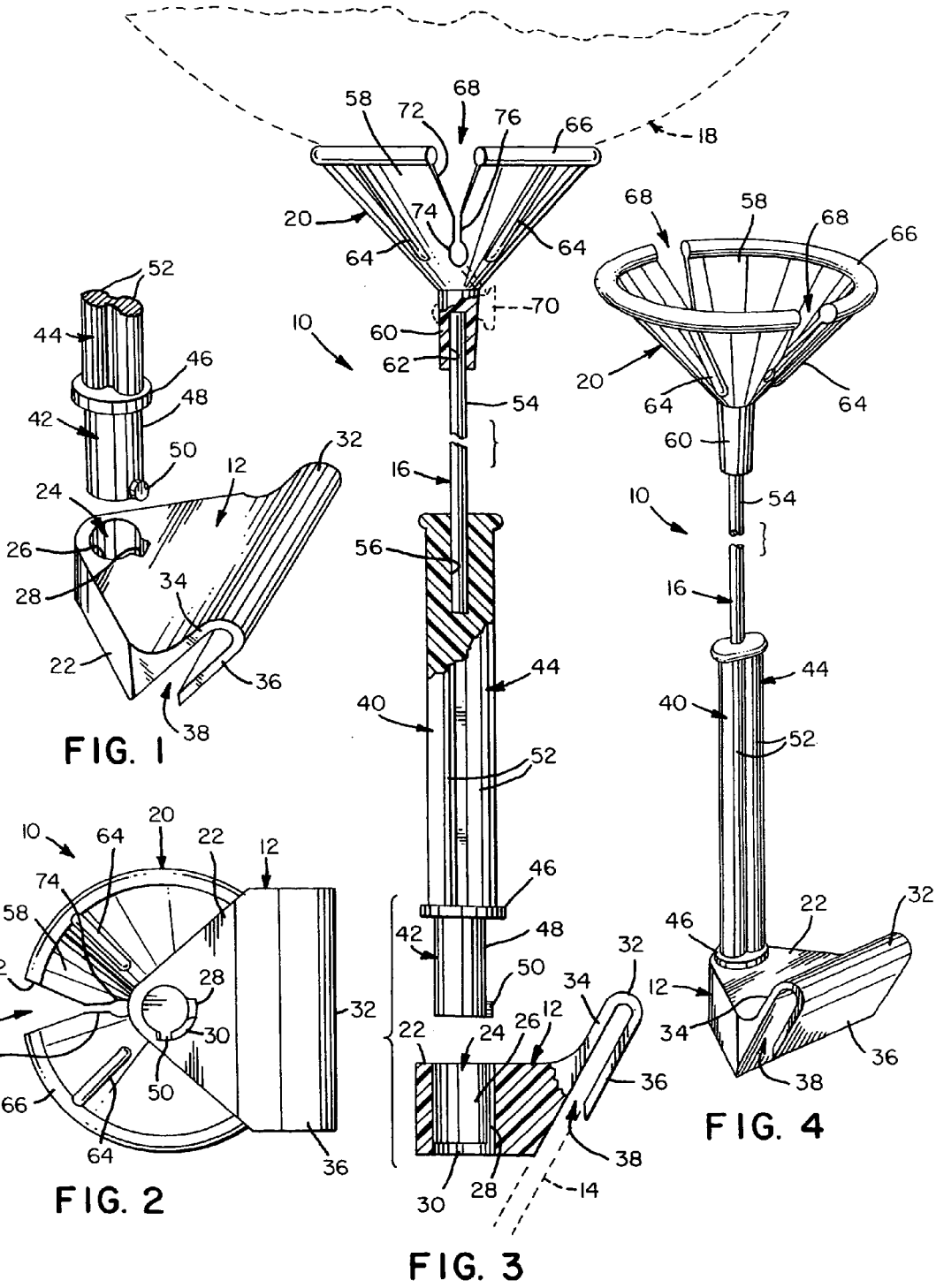
FIG. 1 is a perspective view of a balloon pedestal in accordance with the present invention.
FIG. 2 is a perspective view of the mounting bracket and the mount of the balloon support of the balloon pedestal of FIG. 1 shown detached from one another.
FIG. 3 is a bottom view of the balloon pedestal with the balloon support being locked to the mounting bracket.
FIG. 4 is a side view of the balloon pedestal with portions broken away to reveal details thereof and with the mounting bracket and balloon support being detached from one another.

Referring now to the FIGS., a balloon pedestal in accordance with the present invention is shown at 10. Balloon pedestal 10 includes a mounting bracket 12 adapted for attachment to the top of an automobile window 14. A balloon support 16 is releasably fastened to bracket 12 and extends upwardly from bracket 12. An air-filled balloon 18 can be tied to a slotted cup 20 at the top of support 14 for suspension at a fixed height above automobile window 14.

Mounting bracket 12 has a base portion 22 with a keyhole 24 therein. Keyhole 24 includes a circular bore 26 that extends from the top to the bottom of base portion 22. A rectangular notch 28 runs the length of bore 26 and extends outwardly therefrom into base portion 22. A peripheral groove 30 is provided at the bottom of bore 26 which originates at notch 28 and sweeps an arc of approximately 90° about the center of bore 26. Notch 28 and groove 30 have like depths (distances measured on imaginary lines extending through the central axis of bore 26) that are less than the radius of bore 26. Further, the width of notch 28 and the height of groove 30 are less than the radius of bore 26. While the dimensional relationships of notch 28 and groove 30 to bore 26 minimize the size of the void imparted by keyhole 24 in base portion 22, such relationships are largely a matter of design choice in the purview of a manufacturer of balloon pedestal 10.

Mounting bracket 12 has a hook portion 32 resembling an inverted "U" that extends from base portion 22. As shown, hook portion 32 includes a shank 34, forming one leg of the inverted "U," that extends upwardly and outwardly from base portion of an angle of approximately 60° to accommodate the tilt of window 14. A catch 36, forming the other leg of the inverted "U," is affixed to the top of shank 34 and extends downwardly therefrom so as to form a slot 38 of generally even width.

Balloon support 16 includes a mount 40 for releasable engagement with bracket 12. As shown, mount 40 has a key 42 at its bottom for insertion into keyhole 24 and an elongated handle 44 extending upwardly from key 42 permitting key 42 to be manipulated by a user. At the intersection of key 42 and handle 44, a stop 46 is provided to fix the depth to which key 42 can be inserted into keyhole 24.

Key 42 has cylindrical pin 48 sized for snug, yet slidable and rotatable, positioning within bore 26 of keyhole 24. Projecting outwardly from the bottom of pin 48 is a tab 50 sized for snug, slidable positioning within both notch 28 and peripheral groove 30 of keyhole 24. By pressing key 42 into keyhole 24 to the depth permitted by stop 46 and, then, by twisting handle 44, tab 50 can be rotated from notch 28 into peripheral groove 30 thereby locking support 16 to bracket 12. To enhance the ability of a user to twist handle 44, handle 44 is provided with a pair of elongated, side-by-side bulges 52 that can be readily grasped by the hand of a user.

A flexible rod 54 is affixed to mount 40 and extends upwardly from a socket 56 in the top of handle 44. Rod 54 can be formed of carbon fiber composite, fiberglass, plastic, aluminum or any other suitable material. Rod 54 is provided with dimensions sufficient to simulate the string that is typically tied to a helium-filled balloon and would typically be less than one meter in length and have a diameter of a few millimeters. With such dimensions, rod 54 will tend to sway from side to side in light breezes, shoring up the illusion that balloon 18 atop pedestal 10 really is helium-filled and buoyant in air.

Cup 20 is positioned atop rod 54. Cup 20 has a conical side wall 58 that tapers in diameter to a narrowed bottom from which a stem 60 extends downwardly to receive the top of rod 54 in a socket 62 positioned therein. As shown, conical side wall 58 is reinforced about its sides by four radial ribs 64 positioned at 90° intervals and is further reinforced about its top by and enlarged lip or ring 66. Ring 66 has a sufficient size to receive the bottom of balloon 16 and hold balloon 16 upright in normal outdoor conditions.

Cup 20 is provided with a pair of opposed slots 68 for receiving the nozzle 70 at the bottom of balloon 18. Slots 68 extend downwardly from the top of cup 20, penetrating ring 66 and side wall 58 but avoiding contact with ribs 64. Each slot 68 includes an upper portion 72 configured like a "V" and a lower portion 74 of circular outline and expanded width. A narrowed intermediate portion 76 connects upper and lower portions 72 and 74 together and prevents balloon nozzle 70 from escaping from lower portion 74 once such is inserted therein.

Stem 60 is a cylinder with a longitudinal socket 62 for receiving the top of rod 54. The length and diameter of stem 60 are adequate to provide a strong connection between cup 20 and rod 54 and withstand expected wind loads on balloon 18. Further, stem should be sufficiently dimensioned to permit nozzle 70 of balloon 18 to be easily wrapped around it and tied into a knot so as to secure balloon 18 to support 16. Stem 60 can, if desired, be integrally formed with the balance of cup 20 or can be separately formed and fastened with adhesives or other suitable means.

Use of balloon pedestal 10 is straightforward. First, with mounting bracket 12 and balloon support 16 being secured to one another, air-filled balloon 18 is secured to cup 20 by extending its nozzle 70 through the lower portion 74 of either of slots 68 and tying nozzle 70 into a knot around stem 60. Next, hook portion 32 is clasped upon the top of automobile window 14 with base portion 22 being positioned adjacent the upper/outer surface of window 14 as illustrated in FIG. 3. Finally, by fully engaging the top of window with its top seal, either by rolling up window 14 or closing the vehicle door of which window 14 forms a part, balloon pedestal 10 is locked in place. Passersby should now obtain a favorable impression of both the vehicle supporting balloon pedestal 10 and the dealership employing the balloon pedestal 10.

Should foul weather threaten to damage balloon 18, balloon support 16 can be detached from bracket 12 without opening window 14 or the car door of which window 14 forms a part. To do this, a user need only turn handle 44 so that tab 50 is drawn from peripheral groove 30 and into notch 28 and, then, pull key 42 keyhole 24 by pulling upwardly on handle 44. Support 16 with attached balloon 18 can now be moved to a secure place for later reuse—the small size of balloon pedestal 10 permits it to be stored practically anywhere.

While the invention has been described with a high degree of particularity, it will be appreciated by those skilled in the art that modifications may be made thereto. Therefore, it is to be understood that the present invention is not limited to the sole embodiment described above, but encompasses any and all embodiments within the scope of the following claims.

I claim:

1. A balloon pedestal, comprising a mounting bracket for attachment to a land vehicle, said mounting bracket including:

a hook portion for grasping the top of a window of a land vehicle; and, a base portion being secured to said hook portion, said base portion having a keyhole therein; and, a balloon support being releasably joined to said mounting bracket, said balloon support including;

a mount having a key for selective insertion into, and rotation within, said keyhole whereby rotation of said key selectively locks said balloon support to said mounting bracket, and a handle extending upwardly from said key for manipulating said key;

a rod extending upwardly from said handle; and, a cup positioned atop said rod for carrying a balloon.

2. The balloon pedestal of claim 1 wherein said keyhole includes:

a bore;

a notch running along the length of said bore and extending outwardly therefrom; and' a peripheral groove beginning at said notch and extending about said bore; and said key comprises:

a cylindrical pin for snug, yet slidable and rotatable, positioning within said bore;

a tab projecting outwardly from said cylindrical pin for snug, yet slidable, positioning within said notch and said peripheral groove; and, whereby the selective rotation of said cylindrical pin to position said tab within said notch allows the detachment of said balloon support from said mounting bracket and the selective rotation of said cylindrical pin to position said tab within said peripheral groove locks said balloon support to said mounting bracket.

3. The balloon pedestal of claim 1 wherein said handle is provided with a plurality of elongated bulges for grasping in the hand of a user.

4. The balloon pedestal of claim 1 wherein said cup includes a conical side wall having a slot therein for receiving the nozzle of an inflated balloon, said slot including:

a V-shaped upper portion;

an intermediate portion of even width extending downwardly from said upper portion; and, a lower portion being relatively wider than said intermediate portion.

5. The balloon pedestal of claim 4 wherein said conical side wall is reinforced about its periphery by a plurality of radial ribs.

6. A balloon pedestal, comprising a mounting bracket for attachment to a land vehicle, said mounting bracket including:

a hook portion for grasping the top of a window of a land vehicle; and, a base portion being secured to said hook portion, said base portion having a keyhole therein, said keyhole including;

a bore extending from the top to the bottom of said base portion;

a notch running along the length of said bore and extending outwardly therefrom; and, a peripheral groove beginning at said notch and extending about the bottom of said bore; and, a balloon support for retaining a balloon at a fixed height above said mounting bracket, said balloon support including;

a mount being releasably joined to said mounting bracket, said mount including:

a key for selective insertion into, and rotation within, said keyhole, said key including:

a cylindrical pin for snug, slidable and rotatable positioning within said bore;

a tab projecting laterally from the bottom of said cylindrical pin for snug and slidable positioning within said notch and said peripheral groove; and, whereby the selective rotation of said cylindrical pin to position said tab within said notch allows the detachment of said balloon support from said mounting bracket and the selective rotation of said cylindrical pin to position said tab within said peripheral groove locks said balloon support to said mounting bracket; and, a handle extending upwardly from said key for manipulating said key; and, a rod extending upwardly from said handle; and, a cup positioned atop said rod for cradling a balloon.

7. The balloon pedestal of claim 6 wherein said handle is provided with a plurality of elongated bulges for grasping in the hand of a user.

8. The balloon pedestal of claim 6 wherein said cup includes a conical side wall having a pair of slots therein for receiving the nozzle of an inflated balloon, each said slot including:

a V-shaped upper portion;

an intermediate portion of even width extending downwardly from said upper portion; and, a lower portion being relatively wider than said intermediate portion.

9. The balloon pedestal of claim 4 wherein said conical side wall is reinforced about its periphery by a plurality of radial ribs.

* * * * *